US005706598A

United States Patent [19]

Johnston

[11] Patent Number: 5,706,598

[45] Date of Patent: Jan. 13, 1998

[54] MUZZLE LOADING GUN AND ADAPTOR

[76] Inventor: Kenneth E. Johnston, 3470 Dobie Rd., Okemos, Mich. 48864

[21] Appl. No.: 650,160

[22] Filed: May 20, 1996

[51] Int. Cl.[6] ..... F41C 9/08

[52] U.S. Cl. ..... 42/51; 89/1.3

[58] Field of Search ..... 42/51; 89/1.3

[56] References Cited

U.S. PATENT DOCUMENTS

| | | | |
|---|---|---|---|
| 3,780,464 | 12/1973 | Anderson | 42/51 |
| 4,222,191 | 9/1980 | Lee et al. | 42/51 |
| 4,437,249 | 3/1984 | Brown et al. | 42/51 |
| 4,700,499 | 10/1987 | Knight | 42/51 |
| 4,715,139 | 12/1987 | Rodney, Jr. | 42/51 |
| 4,888,901 | 12/1989 | French et al. | 42/51 |
| 5,010,677 | 4/1991 | Carron | 42/51 |
| 5,109,622 | 5/1992 | Echeberria | 42/51 |
| 5,133,143 | 7/1992 | Knight | 42/51 |
| 5,408,776 | 4/1995 | Mahn et al. | 42/51 |
| 5,467,551 | 11/1995 | Kruse | 42/51 |

*Primary Examiner*—Stephen M. Johnson
*Attorney, Agent, or Firm*—Ian C. McLeod; Mary M. Moyne

[57] ABSTRACT

An adaptor (10) which allows a standard cartridge firing action to be used with a black powder muzzle loading gun (100) is described. The adaptor includes an insert (12) and a nipple (16) and is configured to be inserted into the barrel (108) of the gun adjacent the receiver (104). In use, a standard rifle cartridge casing (150) with a wall (150A) and with a head (150B) at one end containing a primer (152) is loaded into the receiver of the gun. Next, the cartridge casing is moved into the end (108A) of the barrel such that the casing extends into the center bore (14) of the insert and the nipple extends into the inside of the casing. When the gun is fired, the firing pin (114A) contacts the primer which ignites the black powder (118) which expels the projectile (120) from the gun. The ignition of the primer causes the wall of the casing of the cartridge to expand. The casing expands such that the casing is force fit and tightly held in the center bore of the insert. The expansion of the wall of the casing prevents blow back from the explosion from escaping past the adaptor and into the receiver of the gun.

24 Claims, 4 Drawing Sheets

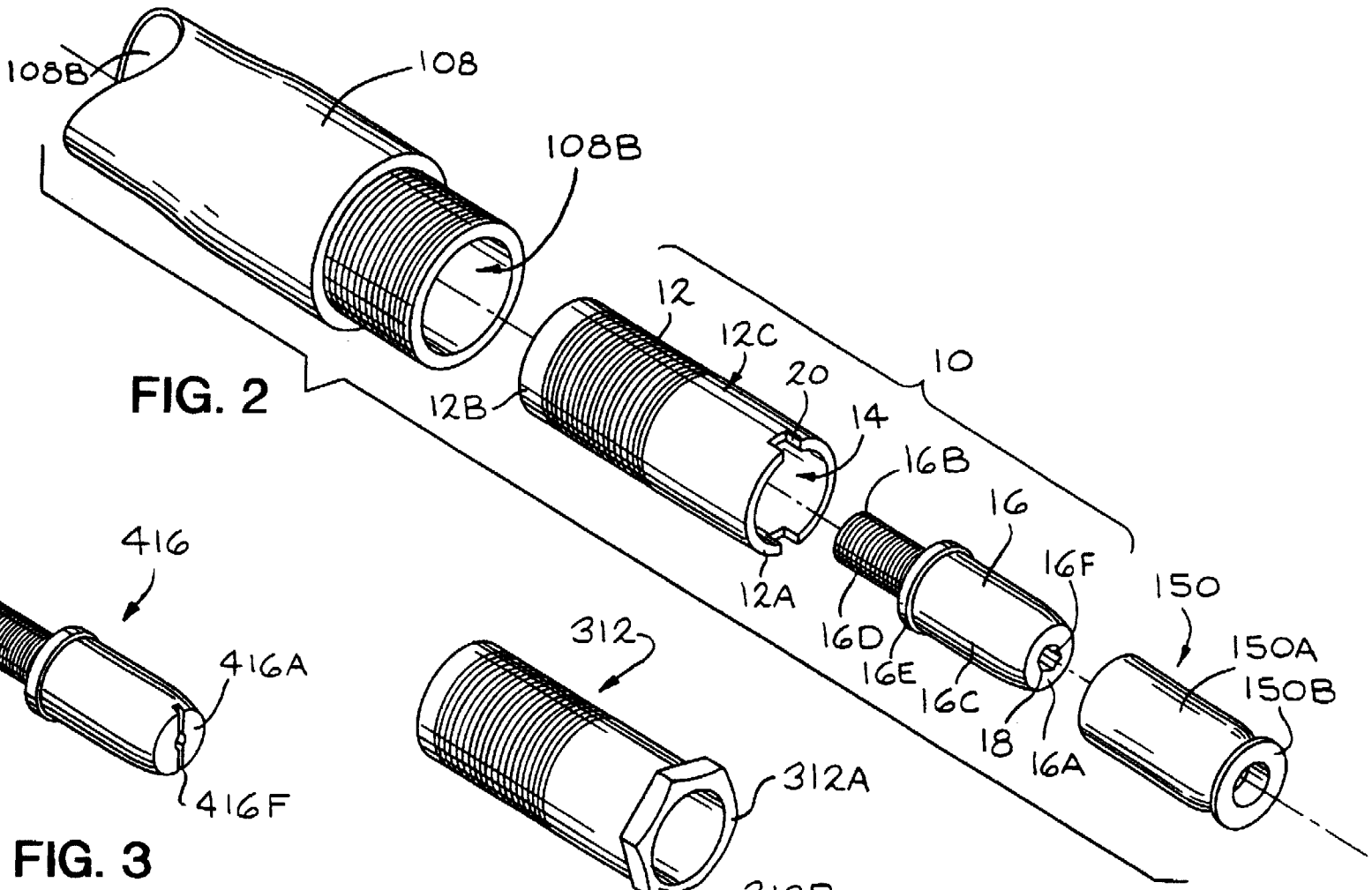
FIG. 2
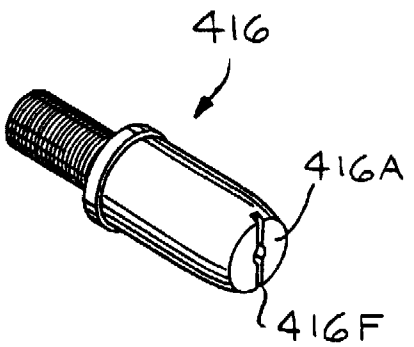
FIG. 3
FIG. 4

MUZZLE LOADING GUN AND ADAPTOR

BACKGROUND OF THE INVENTION (1) Field of the Invention

The present invention relates to a muzzle loading rifle and in particular, an adaptor for allowing a cartridge firing action to be used with a muzzle loading gun. The adaptor is mounted in the barrel of the gun and allows a cartridge casing to be used to provide the primer when using the gun as a muzzle loading gun. The cartridge casing also prevents blow back into the receiver of the gun when the gun is fired which is a safety problem.

(2) Description of the Related Art

The related art has shown various different inserts and adaptors which are used to convert a cartridge firing gun into a black powder muzzle loading gun. Illustrative are U.S. Pat. No. 3,780,464 to Anderson; U.S. Pat. No. 4,437,249 to Brown et al and U.S. Pat. No. 4,222,191 to Lee et al.

In particular, U.S. Pat. No. 5,408,776 to Mahn et al describes an improved ignition means for a muzzle loading weapon. The ignition means includes a breech plug threaded into the barrel of the gun. A primer receiver is mounted in the breech plug and has a primer receiving well at one end. The primer receiver is adapted to use a standard shotgun shell primer as the ignition source. A transition section of the receiving well frictionally engages the primer and acts to hold the primer in place before firing. When the weapon is fired, the blow back gases are intended to eject the primer from the primer receiver, which can be a safety hazard.

Also, of interest are U.S. Pat. No. 4,715,139 to Rodney, Jr.; U.S. Pat. No. 5,010,677 to Verney Carron; U.S. Pat. Nos. 4,700,499 and 5,133,143 both to Knight; and U.S. Pat. No. 5,467,551 to Kruse which show different types of muzzle loading guns.

There remains the need for an adaptor which enables a cartridge firing action to be easily used for a muzzle loading gun. There is also a need to provide an ignition system which prevents blow back into the receiver of the gun during firing.

OBJECTS

It is an object of the present invention to provide a novel muzzle loading gun. It is further an object of the present invention to provide an adaptor which enables a cartridge firing action to be used as part of a muzzle loading gun. Further, it is an object of the present invention to provide an adaptor which allows a standard rifle cartridge casing to be used to provide the primer and to prevent blow back. Still further, it is an object of the present invention to provide an adaptor which is easily mounted in a barrel of a gun to allow a cartridge firing action to be used as part of a muzzle loading gun. Further still, it is an object of the present invention to provide an improved muzzle loading gun which uses a standard rifle cartridge casing to provide the primer and to prevent blow back into the receiver of the gun when the gun is fired. Further, it is an object of the present invention to provide a method for converting a cartridge firing action for use as part of a muzzle loading gun which uses a standard cartridge casing to provide the primer and to prevent blow back when the gun is fired.

These and other objects will become increasingly apparent by reference to the following description and drawings.

BRIEF DESCRIPTION OF THE DRAWINGS

FIG. 2 is a perspective, exploded view showing the barrel 108, the adaptor 10, the insert 12 and the cartridge casing 150.

FIG. 3 is a perspective view of an alternate embodiment of a nipple 416.

FIG. 4 is a perspective view of an alternate embodiment of an insert 312.

DETAILED DESCRIPTION OF THE PREFERRED EMBODIMENTS

Figure 1:
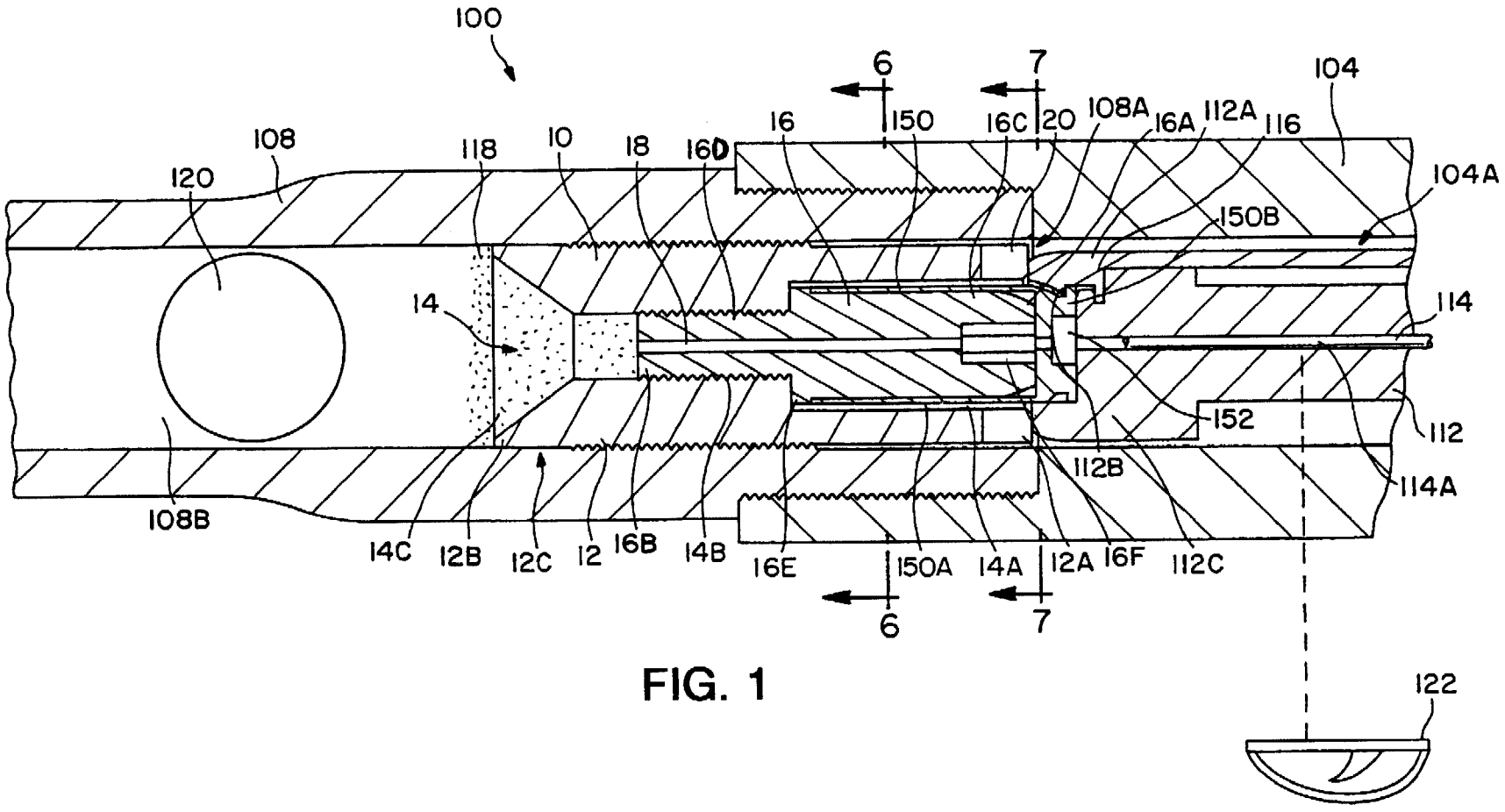
FIG. 1 is a cross-sectional view of a portion of a muzzle loading gun 100 showing a barrel 108 and receiver 104 of a gun 100 and the adaptor 10 with an insert 12 and a nipple 16 with cartridge casing 150 having primer 152 mounted therein.

The present invention relates to an adaptor for use in a muzzle loading gun, a securing means mounting a barrel and a blocking means mounted on the securing means which supports a head of a cartridge, the blocking means mounting a firing pin mechanism, the adaptor comprising: an insert having a first end and a second end with an inside wall and an outside wall between the ends and a center bore defined by the inside wall extending therethrough along a longitudinal axis of the insert, the outside wall being configured to be inserted into the barrel in a sealed relationship to the barrel and adjacent the blocking means; and a nipple provided in the bore of the insert adjacent the first end of the insert and having a center bore extending therethrough in communication with the bore of the insert and with an outside wall in spaced relationship to the inside wall of the insert such that a casing of the cartridge with a primer on a head of the casing can be mounted on the nipple and extend into the bore of the insert adjacent the inside wall such that the nipple extends into the casing adjacent to the primer and such that the blocking means engages the head of the casing of the cartridge with the firing pin mechanism adjacent the primer wherein during firing of the muzzle loading gun the firing pin mechanism engages the primer and produces ignition of powder in the bore of the insert through the bore in the nipple.

Further, the present invention relates to an adaptor for use in a muzzle loading gun, having a receiver means mounting a barrel and a blocking means for supporting a head of the cartridge in the barrel, the blocking means mounting a firing pin mechanism, the adaptor comprising: an insert having a first end and a second end with an inside wall and an outside wall between the ends and a center bore defined by the inside wall therethrough extending along a longitudinal axis of the insert, the outside wall having threads between the ends of the insert, the center bore having a first section, a second section and a third section with the first section adjacent the first end of the insert and the third section adjacent the second end of the insert wherein the second section has threads adjacent the first section, the outside wall being configured to be inserted into the barrel in a sealed relationship to the barrel and adjacent the blocking means; and a nipple mounted in the bore of the insert having a first end and a second end with an inside wall and an outside wall between the ends and a center bore defined by the inside wall extending therethrough, the nipple having a first section adjacent the first end and a second section adjacent the second end, the outside wall having threads at the second section, wherein the nipple is mounted in the second section of the center bore of the insert in sealed relationship with the inside wall of the insert such that the first end of the nipple is adjacent the first end of the insert such that a casing of the cartridge with a primer on a head of the casing can be mounted over the first end of the nipple extending into the center bore of the insert adjacent the inside wall such that the first end of the nipple is adjacent the primer and such that the blocking means engages the head of the cartridge with the firing pin mechanism adjacent the primer wherein during firing of the muzzle loading gun the firing pin mechanism engages the primer and produces ignition of powder in the bore of the insert through the bore in the nipple.

Still further, the present invention relates to a muzzle loading gun having a receiver means mounting a barrel and having a blocking means mounting a firing pin mechanism, the improvement which comprises as part of the barrel: a chamber provided in the barrel having a first end adjacent the receiver means and an opposed second end and an inside wall with a center bore defined by the inside wall extending therethrough along a longitudinal axis of the barrel; and a nipple provided in the bore of the chamber adjacent the first end and having a center bore extending therethrough in communication with the bore of the chamber with an outside wall in spaced relationship to the inside wall of the chamber, such that a casing of the cartridge with a primer can be mounted on the nipple and extend into the bore of the chamber adjacent the inside wall such that the nipple extends into the casing adjacent to the primer and such that the blocking means of the receiver means engages the head of the casing of the cartridge with the firing pin mechanism adjacent the primer, wherein during firing of the muzzle loading gun the firing pin engages the primer and produces ignition of powder in the bore of the chamber through the bore in the nipple.

Further still, the present invention relates to a method for providing a muzzle loading gun with a receiver means mounting a barrel and a blocking means which supports a head of the cartridge, the blocking means mounting a firing pin mechanism, which comprises: mounting an adaptor in the barrel adjacent the receiver means, the adaptor comprising: an insert having a first end and a second end with an inside wall and an outside wall between the ends and a center bore defined by the inside wall extending therethrough along a longitudinal axis of the insert, the outside wall being configured to be inserted into the barrel in a sealed relationship to the barrel and adjacent the blocking means; and a nipple provided in the bore of the insert adjacent the first end of the insert and having a center bore extending therethrough in communication with the bore of the insert and with an outside wall in spaced relationship to the inside wall of the insert, wherein a casing of the cartridge can be inserted in the receiver means of the gun such that the blocking means is adjacent the head of the casing of the cartridge and wherein the blocking means can be moved toward the barrel of the gun with the casing of the cartridge mounted on the blocking means such that the casing of the cartridge is extended into the bore of the insert adjacent the inside wall such that the nipple extends into the casing adjacent to a primer on the casing and such that the blocking means engages the head of the cartridge with the firing pin mechanism adjacent the primer, wherein during firing of the muzzle loading gun, the firing pin mechanism engages the primer and produces ignition of powder in the bore of the insert through the bore in the nipple.

Still further, the present invention relates to a method for firing a muzzle loading gun, the gun having a receiver means mounting a barrel and having a blocking means mounting a firing pin mechanism, the muzzle loading gun having as part of the barrel, a chamber provided in the barrel having a first end adjacent the receiver means and an opposed second end and an inside wall with a center bore defined by the inside wall extending therethrough along a longitudinal axis of the barrel; and a nipple provided in the bore of the chamber adjacent the first end and having a center bore extending therethrough in communication with the bore of the chamber with an outside wall in spaced relationship to the inside wall of the chamber, such that a casing of the cartridge with a primer can be mounted on the nipple and extended into the bore of the chamber adjacent the inside wall such that the nipple extends into the casing adjacent to the primer and such that the blocking means of the receiver means engages the head of the casing of the cartridge with the firing pin mechanism adjacent the primer, wherein during firing of the muzzle loading gun the firing pin engages the primer and produces ignition of powder in the bore of the chamber through the bore in the nipple, the method which comprises: inserting gun powder into an end of the barrel of the gun opposite the receiver means so that the powder is at the opposed end of the chamber; inserting a projectile into the end of the barrel of the gun opposite the receiver means adjacent the powder; inserting a casing of the cartridge with a primer on a head of the casing in the breech opening of the gun adjacent the blocking means; moving the blocking means toward the barrel of the gun wherein the blocking means engages the head of the cartridge with the firing pin mechanism adjacent the primer and the casing is mounted on the nipple and extends into the bore of the chamber adjacent the inside wall so that the nipple extends into the casing adjacent to the primer; and pulling a trigger of the gun such that the firing pin mechanism engages the primer and produces ignition of the powder through the bore in the nipple and causes an explosion which expels the projectile from the end of the barrel of the gun opposite the receiver means, wherein during the explosion, the casing of the cartridge expands such as to provide a sealed relationship with the inside wall of the center bore of the chamber.

Finally, the present invention relates to a method for firing a muzzle loading gun, with a receiver means for mounting the barrel and a blocking means mounting a firing pin mechanism, the method, which comprises: providing in the barrel and adjacent the receiver means, an insert having a first end and a second end with an inside wall and an outside wall between the ends and a bore defined by the inside wall extending therethrough along a longitudinal axis of the insert, the outside wall being configured to be inserted into the barrel in a sealed relationship to the barrel and adjacent the blocking means; a nipple provided in the bore of the insert adjacent the first end of the insert and having a bore extending therethrough in communication with the bore of the insert and with an outside wall in spaced relationship to the inside wall of the insert wherein a casing of the cartridge can be inserted in the receiver means of the gun such that the blocking means is adjacent the head of the casing of the cartridge and wherein the blocking means can be moved toward the barrel of the gun with the casing of the cartridge mounted on the blocking means such that the casing is extended into the bore of the insert adjacent the inside wall such that the nipple extends into the casing adjacent to a primer on the casing and such that the blocking means engages the head of the cartridge with the firing pin mechanism adjacent the primer, wherein during firing of the muzzle loading gun, the firing pin mechanism engages the primer and produces ignition of powder in the bore of the insert through the bore in the nipple; inserting gun powder into an end of the barrel of the gun opposite the receiver means so that the powder is at the opposed end of the insert; inserting a projectile into the end of the barrel of the gun opposite the receiver means adjacent the powder; inserting a casing of the cartridge with a primer on a head of the casing in the receiver means of the gun adjacent the blocking means; moving the blocking means toward the barrel of the gun wherein the blocking means engages the head of the cartridge with the firing pin mechanism adjacent the primer and the casing is mounted on the nipple and extends into the bore of the insert adjacent the inside wall so that the nipple extends into the casing adjacent to the primer; and pulling a trigger of the gun such that the firing pin mechanism engages the primer and produces ignition of the powder through the bore in the nipple and causes an explosion which expels the projectile from the end of the barrel of the gun opposite the receiver, wherein during the explosion, the casing of the cartridge expands such as to provide a sealed relationship with the inside wall of the bore of the insert.

The term "action" as used herein includes the receiver with the bolt and firing pin assembly and the trigger of the gun. The action of the gun may or may not include the barrel and does not include the stock of the gun.

As used herein, the term "cartridge casing" includes metallic casings as well as shotgun shell casings. The casings are used without the bullet.

It will be appreciated that the gun 100 can be arguably manufactured with the insert as an integral part of the barrel. It is preferred to use an adaptor 10 as described herewith.

FIGS. 1 to 7 show the preferred adaptor 10 of the present invention. The adaptor 10 is configured to be used with a standard cartridge firing rifle action and a standard muzzle loading barrel 108 to allow the action 100 to be used as part of a black powder, muzzle loading gun 100. In the preferred embodiment, a muzzle loading barrel 108 is used with a modern action. In general, the turn in rifling of muzzle loading barrels is not as fast as in standard cartridge firing rifle barrels. The standard rifling for muzzle loading barrels is between 1 in 54 and 1 in 28. The slower turning in the rifling of muzzle loading barrels is necessary due to the fouling of the barrel caused by the igniting of the powder. In the preferred embodiment, the use of the primer in the cartridge casing allows for a quick and clean ignition of the powder thus reducing or even eliminating fouling of the barrel. Consequently, the rifling of the barrel in the preferred embodiment is faster then standard muzzle loading barrels. The muzzle loading barrel 108 of the preferred embodiment has a rifling of 1 in 20 for a 45 caliber gun and a 1 in 22 for a 50 caliber gun. The faster rifling allows for more accuracy in firing.

In the preferred embodiment, approximately 1.5 inches (3.8 cm) of the barrel 108 is cut off, opposite the end 108A mounted in the receiver 104. The removed barrel piece (not shown) of the barrel 108 can then be used to preform or pre-engrave the projectile 120 or bullet prior to loading. To preform the projectile 120, the projectile 120 is passed through the removed piece. The soft material, preferably lead, of the projectile 120 enables the rifling in the bore of the barrel piece to become engraved on the outside of the projectile 120. Preferably the projectile 120 allows for easier insertion of the projectile 120 during loading.

In the preferred embodiment, the adaptor 10 is mounted in the muzzle loading barrel 108 of the gun 100. Alternatively, a barrel from a standard cartridge firing rifle can be provided with the adaptor 10. However, it is understood that the adaptor 10 can be used in any type of gun which uses a standard cartridge including pistols, rifles and shotguns. For instance, the adaptor 10 can be mounted in the chamber of a revolver.

In the preferred embodiment, the bolt action is similar to a standard bolt action used in modern rifles. The action includes a receiver or securer or frame 104 and a trigger 122. A barrel 108 of the gun 100 is mounted at one end 108A to the breech opening 104A of the receiver 104. In the preferred embodiment, the barrel 108 is sealably threaded into the end of the receiver 104. The receiver 104 could also be a frame such as with a pistol or some other means for securing the barrel 108 to the action in the gun 100. The inner bore 108B of the barrel 108 is preferably provided with threads adjacent the end 108A which allows the adaptor 10 to be sealably mounted in the barrel 108. The receiver 104 includes a channel 104A in which the bolt 112 is mounted which serves to block or hold the cartridge casing 150 in position in the barrel 108. The bolt 112 has an extractor 112A with a hook 112B at the breech end 112C for grasping the head 150B of the cartridge casing 150 and moving the cartridge casing 150 into position for firing and ejecting the cartridge casing 150 upon firing when the bolt 112 is moved away from the barrel 108 of the gun 100. Preferably, the extractor 112A and face of the bolt 112 are modified from a conventional magazine feed so that the cartridge casing 150 can be inserted onto the face of the bolt 112 and held in place on the face of the bolt 112 by the extractor 112A. The bolt 112 includes a firing pin assembly 114. The bolt 112 is also provided with camming locks 116 adjacent the breech end 112C which lock the bolt 112 and the cartridge casing 150 in place to enable the firing pin 114A to contact the primer 152 during firing. In the preferred embodiment, when using the action with a muzzle loading gun 100, a standard cartridge casing 150 having a wall 150A with a head 150B having a primer 152 is used to provide the primer 152 for firing the muzzle loading gun 100. The cartridge casing 150 does not contain loose powder. In the preferred embodiment, the cartridge casing 150 is a 45 ACP casing.

Figure 6:
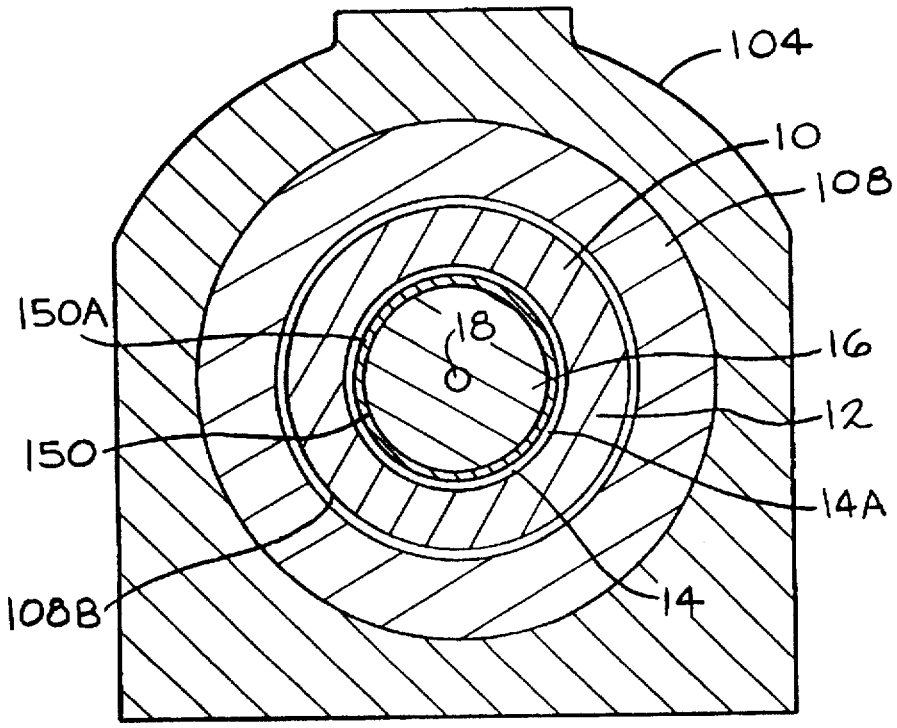
FIG. 6 is a cross-sectional view along line 6—6 of FIG. 1 showing the wall 150A of the cartridge casing 150 between the nipple 16 and the insert 12.
Figure 7:
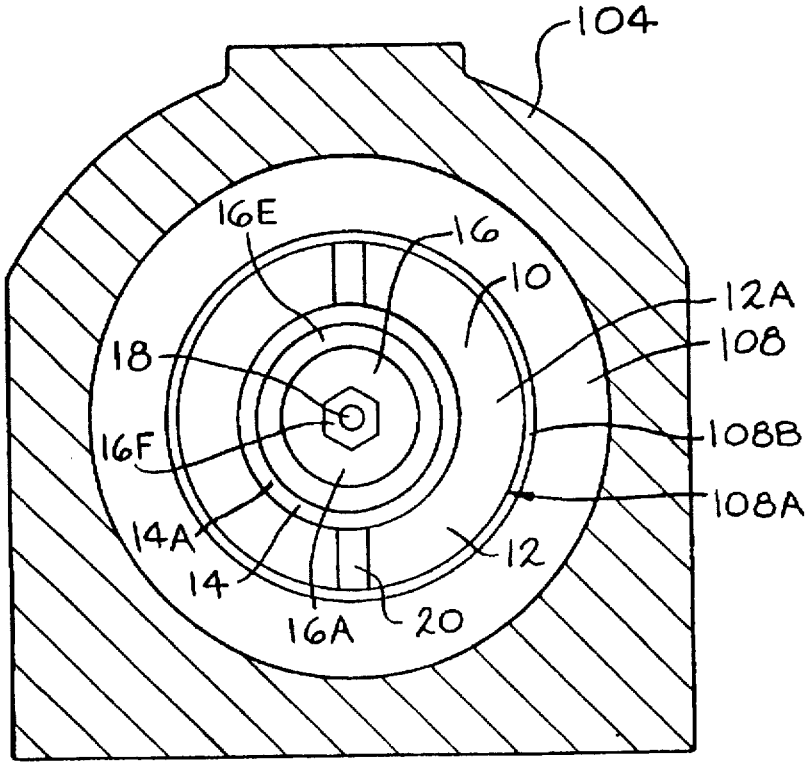
FIG. 7 is a cross-sectional view along line 7—7 of FIG. 1 showing the nipple 16 mounted in the insert 12 and the adaptor 10 mounted in the barrel 108 which is mounted in receiver 104.

FIG. 1 shows the adaptor 10 of the present invention mounted in the end 108A of the barrel 108 adjacent the receiver 104 of a gun 100. The adaptor 10 includes an insert 12 and a nipple 16. The insert 12 is preferably cylindrical in shape having an open first end 12A and an open second end 12B with a sidewall 12C extending therebetween forming a center bore 14 (see particularly FIG. 2) extending completely through the insert 12. In the preferred embodiment, the sidewall 12C of the insert 12 has threads on the outer surface adjacent the second end 12B of the insert 12. The outer diameter of the insert 12 is preferably slightly less than the diameter of the bore 108B of the barrel 108 of the gun 100 such that the insert 12 is easily inserted into the bore 108B of the barrel 108 of the gun 100. The threads of the insert 12 engage the threads of the bore 108B of the barrel 108 such that the adaptor 10 is sealably mounted in the bore 108B of the barrel 108 (FIG. 6). In the preferred embodiment, the bore 108B of the barrel 108 adjacent the end 108A of the barrel 108 has a diameter of 0.625 inch (1.59 cm). The outer diameter of the insert 12 in the preferred embodiment is slightly less than 0.625 inch (1.59 cm) unthreaded. The center bore 14 of the insert 12 preferably has three sections each having a different diameter (FIG. 1). The first section 14A is adjacent the first end 12A of the insert 12 and extends approximately half way into the insert 12. The inner sidewall of the first section 14A is preferably smooth. The inner diameter of the first section 14A of the center bore 14 is preferably slightly larger than the outer diameter of the wall 150A of the cartridge casing 150 such that the cartridge casing 150 is easily inserted into the first section 14A of the center bore 14 (FIG. 6). The first section 14A of the center bore 14 of the insert 12 provides a chamber in the barrel 108 for mounting the cartridge casing 150. In the preferred embodiment, the first section 14A has a diameter of 0.458 inch (1.16 cm) to fit a 45 ACP cartridge casing 150. The length of the first section 14A of the center bore 14 is preferably slightly longer than the length of the wall 150A of the cartridge casing 150 such that when the cartridge casing 150 is inserted into the bore 108B, the head 150B of the cartridge casing 150 is adjacent the first end 12A of the insert 12 (FIG. 1). In the preferred embodiment, the first section 14A has a length slightly shorter than the nipple 16. The nipple 16 establishes the head space. The second section 14B of the center bore 14 has a diameter smaller than the diameter of the first section 14A. The second section 14B is preferably provided with threads adjacent the first section 14A of the center bore 14. Alternatively, the second section 14B is completely threaded. The third section 14C of the center bore 14 extends from the second section 14B to the second end 12B of the insert 12. The third section 14C is preferably funnel shaped with the apex adjacent the second section 14B of the center bore 14. The first end 12A of the insert 12 is preferably provided with two notches 20 spaced 180° C. apart around the circumference of the first end 12A (FIGS. 2 and 7). The notches 20 allow for removal of the insert 12 using a screwdriver (not shown) or a special removal tool (not shown) when the insert 12 is threadably inserted into the barrel 108 of the gun 100. Alternatively, as shown in FIG. 4, the first end 312A of the insert 312 has a bolt shaped head 312B which allows for insertion and removal of the insert 312 using a socket wrench tool (not shown). The insert 12 preferably has a length of 1.5 inches (2.3 cm) and is constructed of stainless steel.

The nipple 16 is configured to be mounted in the center bore 14 of the insert 12. The nipple 16 has a first end 16A and a second end 16B with a first section 16C and a second section 16D extending therebetween with a center bore 18 extending completely through the nipple 16. The first section 16C of the nipple 16 is cylindrical with an annular flange 16E at one end adjacent the second section 16D. Preferably, the diameter of the first section 16C is slightly smaller than the inner diameter of the wall 150A of the cartridge casing 150 such that the cartridge casing 150 is easily mounted over the nipple 16. The first section 16C at the first end of the nipple 16 has a rounded edge or radius which acts to guide or pilot the cartridge casing 150 over the first section 16C of the nipple 16. In the preferred embodiment, the diameter of the first section 14A is slightly less than 0.458 inch (1.16 cm). The diameter of the flange 16E of the first section 16C of the nipple 16 is preferably greater than the inner diameter of the wall 150A of the cartridge casing 150 such that the end of the wall 150A abuts the flange 16E and does not extend beyond the flange 16E when the cartridge casing 150 is fully inserted over the nipple 16. In the preferred embodiment, the diameter of the flange 16E is 0.45 inch (1.16 cm). The outer diameter of the first section 16C and the flange 16E are both smaller than the diameter of the first section 14A of the center bore 14 of the insert 12 such that the nipple 16 is easily inserted into the center bore 14 of the insert 12. The second section 16B of the nipple 16 has a diameter slightly less than the diameter of the second section 14B of the center bore 14 of the insert 12. The second section 16B of the nipple 16 is preferably provided with threads which are threadably mated with the threads of the second section 14B of the center bore 14 of the insert 12 when the nipple 16 is mounted in the insert 12. The center bore 18 of the nipple 16 preferably has essentially the same diameter along its length. In the preferred embodiment, the center bore 18 of the nipple 16 has a diameter of 0.125 inch (0.32 cm). The nipple 16 has a diameter which is preferably between 0.375 and 0.425 inch (0.95 to 1.07 cm). The opening of the first end 16A of the nipple 16 is preferably provided with a six sided indentation 16F which allows the nipple 16 to be rotated using an allen wrench (not shown) for easily inserting or removing the nipple 16 from the insert 12 (FIG. 7). Alternatively, the first end 416A of the nipple 416 is provided with a notch 416F which allows the nipple 416 to be removed or inserted into the insert 12 using a screwdriver (not shown) (FIG. 3). The nipple 216 could also be constructed as an integral part of the insert 212. The nipple 216 preferably has a length of about 2.5 inch (6.35 cm) and is constructed of stainless steel.

Figure 5:
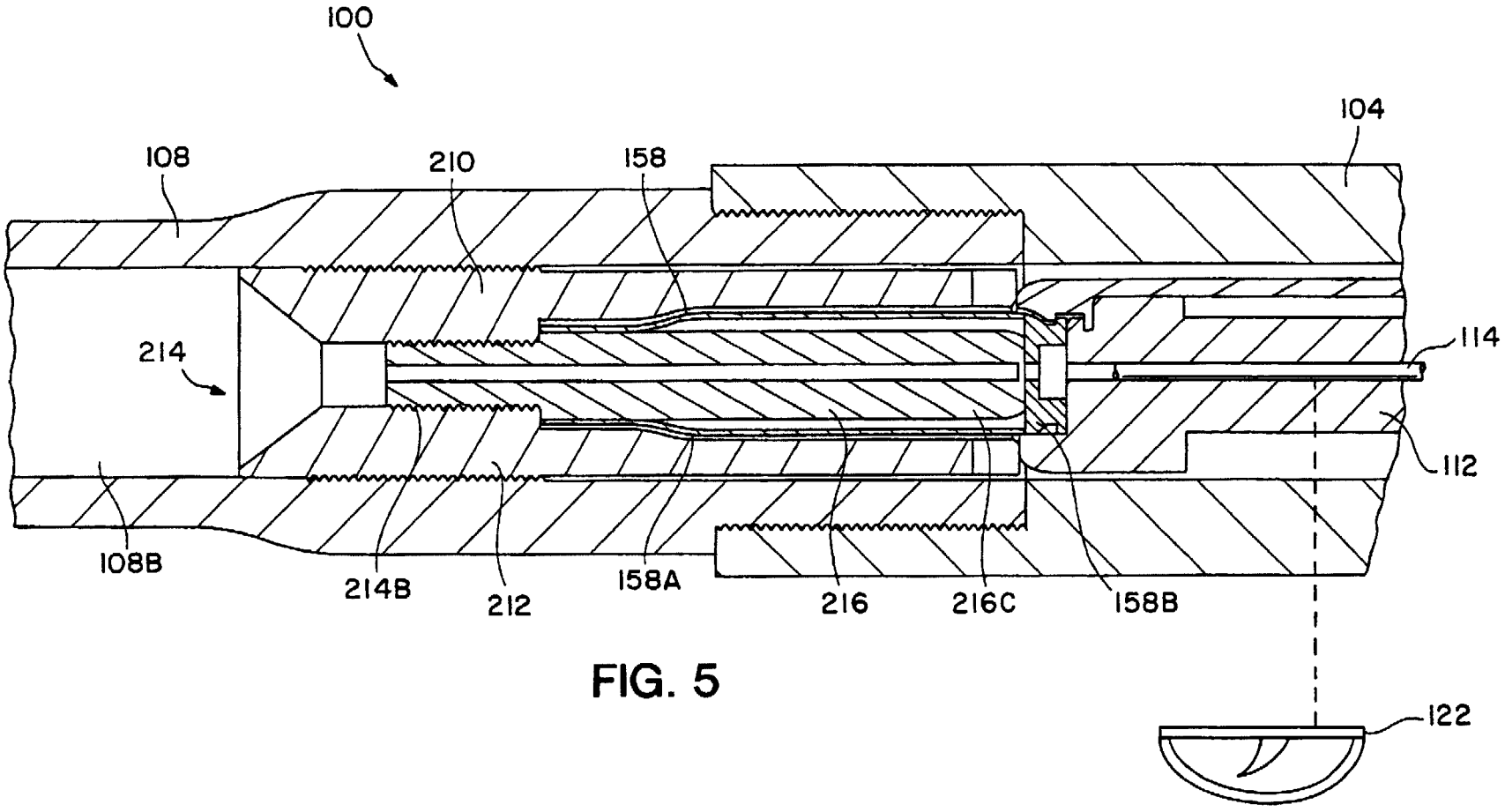
FIG. 5 is a cross-sectional view of an alternate embodiment of an adaptor 210.

In a second embodiment of the adaptor 210 shown in FIG. 5, the first section 216C of the nipple 216 has a constant diameter without the annular flange at one end. In this embodiment, the length of the first section 216C of the nipple 216 is equal to the length of the wall 158A of the cartridge casing 158. Thus, when the cartridge casing 158 is fully inserted into the insert 212 around the nipple 216, the end of the wall 158A opposite the head 158B is adjacent the second section 214B of the center bore 214 of the insert 212. This alternate embodiment is particularly useful for converting a cartridge rifle into a muzzle loading gun. It could also be originally manufactured as a muzzle loading rifle.

IN USE

To use the adaptor 10 to convert a standard cartridge firing rifle 100 into a black powder muzzle loading rifle, the adaptor 10 is first mounted into the end 108A of the barrel 108 of the gun 100 adjacent the receiver 104. Before mounting the adaptor 10, the bore 108B of the gun 100 adjacent the receiver 104 must be bore threaded to allow for threadably mounting the adaptor 10 in the barrel 108. In the preferred embodiment, before mounting the insert 12 in the barrel 108, the nipple 16 is mounted in the insert 12. To mount the nipple 16 in the insert 12, the second section 16D of the nipple 16 is inserted into the center bore 14 of the insert 12 adjacent the first end 12A. The nipple 16 is inserted until the second end 16B encounters the smaller diameter, second section 14B of the center bore 14. The nipple 16 is then rotated such that the threads of the second section 16D of the nipple 16 engage the threads of the second section 14B of the center bore 14 of the insert 12. Preferably, the nipple 16 is first initially hand inserted and rotated. However, as the nipple 16 extends into the center bore 14, preferably the user employs a tool such as an allen wrench (not shown) or a screwdriver (not shown), to securely mount the nipple 16 in the insert 12. Preferably, the nipple 16 is tightened such that the flange 16 of the first section 16C of the nipple 16 is adjacent the second section 14B of the center bore 14 of the insert 12. When correctly mounted, the second section 16D of the nipple 16 and the second section 14B of the center bore 14 of the insert 12 are sealingly engaged. In an alternate embodiment (not shown), the nipple 16 is constructed as an integral part of the insert 12. In another alternate embodiment (not shown), the nipple 16 is permanently mounted in the center bore 18 of the 12 insert using any well known fastening means such as welding. Once the nipple 16 is in place, the adaptor 10 is then mounted in the barrel 108 of the gun 100. To mount the adaptor 10, the second end 12B of the insert 12 is inserted into the end 108A of the barrel 108. The insert 12 is easily inserted until the second end 12B of the insert 12 encounters the threads in the bore 108B of the barrel 108. The insert 12 is then rotated such that the threads on the sidewall 12C of the insert 12 engage the threads in the bore 108B of the barrel 108 (FIG. 2). In the preferred embodiment, to rotate the insert 12, the user uses a screwdriver. Alternatively, the user uses a socket wrench which fits over the first end 12A of the insert 12 and allows for easier rotation of the insert 12 (FIG. 4). The insert 12 is preferably rotated into the barrel 108 until all the threads of the insert 12 are engaged by the threads in the bore 108B of the barrel 108. When correctly mounted, the insert 12 and the barrel 108 are preferably sealingly engaged. In an alternate embodiment (not shown), the insert 12 is constructed as an integral part of the barrel 108 to form an improved muzzle loading gun.

Once the adaptor 10 is mounted in the barrel 108 of the gun 100, the gun 100 is ready to be used as a black powder muzzle loading gun. First, the black powder 118 is filled into the end of the barrel 108 opposite the end 108A of the barrel 108 mounted in the receiver 104 such that the black powder 118 is in the third section 14C of the center bore 14 of the insert 12 adjacent the second end 12B of the insert 12. In the preferred embodiment, between 75 and 100 grains is used for a 45 caliber cartridge casing. The black powder 118 is packed into the barrel 108 using a ramrod. Next, the projectile (ball) 120 is slid into the end of the barrel 108. The projectile is preferably either a ball, miniballs or a conical bullet. When a ball as the projectile 120 is used, a greased patch (not shown) is optionally (not preferred) inserted with the projectile 120 such that the patch is on top of the black powder 118 and the projectile 120 is on top of the patch. The greased patch assists in the insertion of the ball 120 and also acts to ensure that the full force of the exploding black powder 118 is transferred to the projectile 120 when the gun 100 is fired. The patch is particularly used with rifled barrels 108.

Once the black powder 118 and the projectile 120 are positioned in the barrel 108, then the bolt 112 in the receiver 104 is pulled back to allow for loading of a cartridge casing 150. The cartridge casing 150 is preferably a standard cartridge casing 150 having only a wall 150A, a head 150B and a primer 152. The cartridge casing 150 is loaded such that the hook 112B of the extractor 112A at the end of the bolt 112 grasps the head 150B of the cartridge casing 150. Usually, the cartridge casing 150 is loaded through a slot in the top of the bolt 112. Next, the bolt 112 is moved forward toward the end 108A of the barrel 108 which moves the cartridge casing 150 forward. The bolt 112 is then rotated to lock the bolt 112 in place. When the bolt 112 is locked in place, the cartridge casing 150 is located in the adaptor 10 such that the wall 150A extends into the adaptor 10 between the nipple 16 and the first section 14A of the center bore 14 of the insert 12 (FIG. 1). The head 150B of the cartridge casing 150 is preferably in contact with the first end 16A of the nipple 16 with the primer 152 positioned over the opening of the center bore 18 of the nipple 16. The gun 100 is fired similarly to an ordinary gun; by pulling the trigger 122. When the trigger 122 is pulled, the firing pin mechanism 114 in the bolt 112 moves the firing pin 114A forward and into contact with the primer 152. The spark of the primer 152 travels down the center bore 18 of the nipple 16 and ignites the black powder 118. The explosion of the black powder 118 expels the projectile 120 from the barrel 108 of the gun 100.

In the preferred embodiment, after the firing pin 114A contacts the primer 152, the resulting ignition of the powder causes the wall 150A of the cartridge casing 150 to expand. As the wall 150A expands, the wall 150A makes contact with the center bore 14 of the insert 12.

Consequently, as a result of firing the gun 100, the wall 150A of the cartridge casing 150 becomes friction fitted within the center bore 14 of the insert 12. The resulting close fit of the wall 150A prevents blow back of exploding powder outside the cartridge casing 150 which travels up through the center bore 18 of the nipple 16 to the cartridge casing 150. Thus, no black powder 118 enters the receiver 104 which prevents the receiver 104 from becoming dirty. Once the gun 100 has been fired, the bolt 112 is moved backwards which causes the cartridge 150 to be extracted from the adaptor 10 and ejected from the gun 100. In the preferred embodiment, the adaptor 10 is removed to allow for cleaning of the gun 100 and to allow the gun 100 to be used as a standard rifle 100.

It is intended that the foregoing description be only illustrative of the present invention and that the present invention be limited only by the hereinafter appended claims.

I claim:

1. An adaptor for use in a muzzle loading gun, having a receiver means mounting a barrel and a blocking means mounted on the receiver means for supporting a head of a cartridge during firing of the gun, the blocking means mounting a firing pin mechanism, the adaptor comprising:

(a) an insert having a first end and a second end with an inside wall and an outside wall between the ends and a center bore defined by the inside wall extending therethrough along a longitudinal axis of the insert, the outside wall being configured to be inserted into the barrel in a sealed relationship to the barrel and adjacent the blocking means; and (b) a nipple provided in the bore of the insert adjacent the first end of the insert and having a center bore extending therethrough in communication with the bore of the insert and with an outside wall in spaced relationship to the inside wall of the insert such that a casing of the cartridge with a primer on a head of the casing can be mounted on the nipple and extend into the bore of the insert adjacent the inside wall of the insert such that the nipple extends into the casing adjacent to the primer and such that the blocking means engages the head of the casing of the cartridge with the firing pin mechanism adjacent the primer wherein during firing of the muzzle loading gun the firing pin mechanism engages the primer and produces ignition of powder in the bore of the insert through the bore in the nipple.

2. The adaptor of claim 1 wherein the outside wall of the insert has threads between the ends and wherein the barrel of the muzzle loading gun has threads adjacent the receiving means of the gun which engage the treads of the insert and act to hold the insert in the sealed relationship in the barrel of the gun.

3. The adaptor of claim 2 wherein the first end of the insert is provided with a notch which allows the insert to be removed from the barrel of the gun.

4. The adaptor of claim 1 wherein the center bore of the insert includes a first section which mounts the cartridge casing, a second section adjacent the first section for mounting the nipple and a third section for holding powder.

5. The adaptor of claim 4 wherein the inside wall of the insert has mounting means on the second section of the center bore of the insert adjacent the first section for mounting the nipple.

6. The adaptor of claim 5 wherein the nipple has a first section and a second section with the outside wall of the nipple at the second section having threads which engage threads of the second section of the center bore of the insert to mount the nipple in the insert.

7. The adaptor of claim 6 wherein the first section of the nipple is provided with a shoulder adjacent the second section of the nipple and wherein a diameter of the shoulder is greater than a diameter of the casing of the cartridge which prevents the cartridge from extending beyond the shoulder.

8. The adaptor of claim 7 wherein the distance between the shoulder and a first end of the nipple adjacent the first end of the insert is equal to a length of the casing of the cartridge such that when the cartridge is mounted over the nipple with the casing adjacent the shoulder of the nipple, the head of the casing of the cartridge is in contact with the first end of the nipple.

9. The adaptor of claim 4 wherein the third section of the center bore is funnel shaped such as to allow a projectile to be mounted adjacent the second end of the insert and prevent the projectile from extending into the second section of the center bore.

10. The adaptor of claim 1 wherein the nipple is separate from the insert and has a first end and a second end and is mounted in the center bore of the insert such that the first end of the nipple is adjacent the first end of the insert.

11. The adaptor of claim 10 wherein the nipple has a notch in the first end which allows the nipple to be removed from the insert.

12. The adaptor of claim 10 wherein the first end of the nipple is flush with the first end of the insert.

13. The adaptor of claim 10 wherein the center bore of the insert is coaxial with the center bore of the nipple and wherein the insert is coaxial with the nipple.

14. The adaptor of claim 1 wherein the cartridge casing is a standard 45 caliber automatic cartridge casing.

15. The adaptor of claim 1 wherein the head of the casing of the cartridge has an opening and wherein a diameter of the center bore of the nipple is the same as a diameter of the opening in the head of the casing of the cartridge.

16. An adaptor for use in a muzzle loading gun, having a receiver means mounting a barrel and a blocking means for supporting a head of a cartridge in the barrel during firing of the gun, the blocking means mounting a firing pin mechanism, the adaptor comprising:

(a) an insert having a first end and a second end with an inside wall and an outside wall between the ends and a center bore defined by the inside wall therethrough extending along a longitudinal axis of the insert, the outside wall having threads between the ends of the insert, the center bore having a first section, a second section and a third section with the first section adjacent the first end of the insert and the third section adjacent the second end of the insert wherein the second section has threads adjacent the first section, the outside wall being configured to be inserted into the barrel in a sealed relationship to the barrel and adjacent the blocking means; and (b) a nipple mounted in the bore of the insert having a first end and a second end with an inside wall and an outside wall between the ends and a center bore defined by the inside wall extending therethrough, the nipple having a first section adjacent the first end and a second section adjacent the second end, the outside wall having threads at the second section, wherein the nipple is mounted in the second section of the center bore of the insert in sealed relationship with the inside wall of the insert such that the first end of the nipple is adjacent the first end of the insert such that a casing of the cartridge with a primer on a head of the casing can be mounted over the first end of the nipple extending into the center bore of the insert adjacent the inside wall such that the first end of the nipple is adjacent the primer and such that the blocking means engages the head of the cartridge with the firing pin mechanism adjacent the primer wherein during firing of the muzzle loading gun the firing pin mechanism engages the primer and produces ignition of powder in the bore of the insert through the bore in the nipple.

17. In a muzzle loading gun having a receiver means mounting a barrel and having a blocking means for holding a head of a cartridge during firing of the gun and mounting a firing pin mechanism the improvement which comprises as part of the barrel:

(a) a chamber provided in the barrel having a first end adjacent the receiver means and an opposed second end and an inside wall with a center bore defined by the inside wall extending therethrough along a longitudinal axis of the barrel; and (b) a nipple provided in the bore of the chamber adjacent the first end and having a center bore extending therethrough in communication with the bore of the chamber with an outside wall in spaced relationship to the inside wall of the chamber, the nipple configured to mount a casing of the cartridge with a primer so that the nipple extends into the bore of the chamber adjacent the inside wall and the nipple extends into the casing adjacent to the primer and such that the blocking means of the receiver means engages the head of the casing of the cartridge with the firing pin mechanism adjacent the primer, wherein during firing of the muzzle loading gun, the firing pin engages the primer and produces ignition of powder in the bore of the chamber through the bore in the nipple.

18. A method for providing a muzzle loading gun, with a receiver means mounting a barrel and a blocking means which supports a head of a cartridge during firing of the gun, the blocking means mounting a firing pin mechanism, which comprises:

mounting an adaptor in the barrel adjacent the receiver means, the adaptor comprising: an insert having a first end and a second end with an inside wall and an outside wall between the ends and a center bore defined by the inside wall extending therethrough along a longitudinal axis of the insert, the outside wall being configured to be inserted into the barrel in a sealed relationship to the barrel and adjacent the blocking means; and a nipple provided in the bore of the insert adjacent the first end of the insert and having a center bore extending therethrough in communication with the bore of the insert and with an outside wall in spaced relationship to the inside wall of the insert, wherein a casing of the cartridge can be inserted in the receiver means of the gun such that the blocking means is adjacent the head of the casing of the cartridge and wherein the blocking means can be moved toward the barrel of the gun with the casing of the cartridge mounted on the blocking means such that the casing of the cartridge is extended into the bore of the insert adjacent the inside wall such that the nipple extends into the casing adjacent to a primer on the casing and such that the blocking means engages the head of the cartridge with the firing pin mechanism adjacent the primer, wherein during firing of the muzzle loading gun the firing pin mechanism engages the primer and produces ignition of powder in the bore of the insert through the bore in the nipple.

19. The method of claim 18 wherein the outside wall of the insert has threads which threadably engage threads provided in the barrel adjacent the receiver means of the gun for mounting the insert in the sealed relationship in the barrel of the gun.

20. The method of claim 19 wherein the first end of the insert has a notch which allows the insert to be rotated for insertion and removal from the barrel of the gun.

21. The method of claim 18 wherein the nipple has threads on the outside wall which engage threads on the inside wall of the insert and wherein the nipple is inserted in the center bore of the insert by rotating the nipple such that the threads on the nipple engage the threads of the insert.

22. The method of claim 21 wherein the nipple has opposed ends with a notch at one end which allows the nipple to be inserted into the center bore of the insert.

23. A method for firing a muzzle loading gun, the gun having a receiver means mounting a barrel and having a blocking means for holding a head of a cartridge during firing of the gun and mounting a firing pin mechanism, the muzzle loading gun having as part of the barrel, a chamber provided in the barrel having a first end adjacent the receiver means and an opposed second end and an inside wall with a center bore defined by the inside wall extending therethrough along a longitudinal axis of the barrel; and a nipple provided in the bore of the chamber adjacent the first end and having a center bore extending therethrough in communication with the bore of the chamber with an outside wall in spaced relationship to the inside wall of the chamber, the nipple configured to mount a casing of the cartridge with a primer so that the nipple extends into the bore of the chamber adjacent the inside wall and the nipple extends into the casing adjacent to the primer and such that the blocking means of the receiver means engages the head of the casing of the cartridge with the firing pin mechanism adjacent the primer, wherein during firing of the muzzle loading gun the firing pin mechanism engages the primer and produces ignition of powder in the bore of the chamber through the bore in the nipple, the method which comprises:

(a) inserting gun powder into an end of the barrel of the gun opposite the receiver means so that the powder is at the opposed end of the chamber;

(b) inserting a projectile into the end of the barrel of the gun opposite the receiver means adjacent the powder;

(c) inserting the casing of the cartridge with the primer on the head of the casing in the breech opening of the gun adjacent the blocking means;

(d) moving the blocking means toward the barrel of the gun wherein the blocking means engages the head of the cartridge with the firing pin mechanism adjacent the primer and the casing is mounted on the nipple and extends into the bore of the chamber adjacent the inside wall so that the nipple extends into the casing adjacent to the primer; and (e) pulling a trigger of the gun such that the firing pin mechanism engages the primer and produces ignition of the powder through the bore in the nipple and causes an explosion which expels the projectile from the end of the barrel of the gun opposite the receiver means, wherein during the explosion, the casing of the cartridge expands such as to provide a sealed relationship with the inside wall of the center bore of the chamber.

24. A method for firing a muzzle loading gun, with a receiver means for mounting the barrel and a blocking means for supporting a head of a cartridge in the barrel during firing of the gun, the blocking means mounting a firing pin mechanism, the method which comprises:

(a) providing in the barrel and adjacent the receiver means, an insert having a first end and a second end with an inside wall and an outside wall between the ends and a bore defined by the inside wall extending therethrough along a longitudinal axis of the insert, the outside wall being configured to be inserted into the barrel in a sealed relationship to the barrel and adjacent the blocking means; a nipple provided in the bore of the insert adjacent the first end of the insert and having a bore extending therethrough in communication with the bore of the insert and with an outside wall in spaced relationship to the inside wall of the insert wherein a casing of the cartridge can be inserted in the receiver means of the gun such that the blocking means is adjacent the head of the casing of the cartridge and wherein the blocking means can be moved toward the barrel of the gun with the casing of the cartridge mounted on the blocking means such that the casing is extended into the bore of the insert adjacent the inside wall such that the nipple extends into the casing adjacent to a primer on the casing and such that the blocking means engages the head of the cartridge with the firing pin mechanism adjacent the primer, wherein during firing of the muzzle loading gun the firing pin mechanism engages the primer and produces ignition of powder in the bore of the insert through the bore in the nipple;

(b) inserting gun powder into an end of the barrel of the gun opposite the receiver means so that the powder is at the opposed end of the insert;

(c) inserting a projectile into the end of the barrel of the gun opposite the receiver means adjacent the powder;

(d) inserting the casing of the cartridge with the primer on the head of the casing in the receiver means of the gun adjacent the blocking means;

(e) moving the blocking means toward the barrel of the gun wherein the blocking means engages the head of the cartridge with the firing pin mechanism adjacent the primer and the casing is mounted on the nipple and extends into the bore of the insert adjacent the inside wall so that the nipple extends into the casing adjacent to the primer; and (f) pulling a trigger of the gun such that the firing pin mechanism engages the primer and produces ignition of the powder through the bore in the nipple and causes an explosion which expels the projectile from the end of the barrel of the gun opposite the receiver, wherein during the explosion, the casing of the cartridge expands such as to provide a sealed relationship with the inside wall of the bore of the insert.

* * * * *